US009717637B2

(12) United States Patent
Bucher

(10) Patent No.: US 9,717,637 B2
(45) Date of Patent: Aug. 1, 2017

(54) LATERAL SUPPORT ASSEMBLY

(71) Applicant: Adaptive Engineering Lab, Inc., Milwaukee, WI (US)

(72) Inventor: Ronald S. Bucher, New Berlin, WI (US)

(73) Assignee: Adaptive Engineering Lab, Inc., Milwaukee, WI (US)

( * ) Notice: Subject to any disclaimer, the term of this patent is extended or adjusted under 35 U.S.C. 154(b) by 377 days.

(21) Appl. No.: 14/509,646

(22) Filed: Oct. 8, 2014

(65) Prior Publication Data

US 2016/0101006 A1 Apr. 14, 2016

(51) Int. Cl.
*A61G 5/10* (2006.01)
*A61G 5/12* (2006.01)

(52) U.S. Cl.
CPC ..... *A61G 5/12* (2013.01); *A61G 5/122* (2016.11); *A61G 5/124* (2016.11); *A61G 2203/78* (2013.01)

(58) Field of Classification Search
CPC ..... A61G 2005/12; A61G 2005/121; A61G 2005/122; A61G 2005/124; A61G 2005/125; A61G 2005/1091; A61G 2005/1067; A61G 5/10; A61G 5/12; A61G 5/122; A61G 5/124; A61G 5/125; A61G 5/1048; A47C 7/62; A47C 7/426; A47C 7/46
USPC ..... 297/411.1, 411.3, 411.35, DIG. 4, 284.9; 16/324, 326; 248/288.5, 292.12, 282.1
See application file for complete search history.

(56) References Cited

U.S. PATENT DOCUMENTS 364,571 A * 6/1887 Bowers ..... E02F 3/88 37/326
790,217 A * 5/1905 Mason ..... A47B 57/04 108/1

(Continued)

FOREIGN PATENT DOCUMENTS

CN 201029966 Y 3/2008
CN 202821888 U 3/2013

(Continued)

OTHER PUBLICATIONS

Stealth Products, Inc., TWBL—Swing Away Link Style Thoracic Lateral Hardware, Product Information, Dec. 3, 2010, 2 pages.

(Continued)

*Primary Examiner* — Anne Marie Boehler
(74) *Attorney, Agent, or Firm* — Quarles & Brady LLP

(57) ABSTRACT

A lateral support assembly for attachment to a wheelchair includes a mounting portion for attachment to the wheelchair, a pad support portion for attachment to a pad, and a link sub-assembly including one or more links that connect the mounting portion to the pad support portion. The mounting portion includes an attachment part, a hinged part, and a sliding part. The attachment part is adapted to be affixed to the wheelchair and the hinged part is connected to the attachment part and is selectively pivotable about a first rotational axis. The pad support portion includes a pad bracket coupled to a secondary housing in which the pad bracket is selectively pivotable about a second rotational axis. The sliding part is connected to the hinged part and is selectively extendable forward.

20 Claims, 12 Drawing Sheets

(56) References Cited

U.S. PATENT DOCUMENTS

| | | | | |
|---|---|---|---|---|
| 1,275,311 | A * | 8/1918 | Schumacher et al. | F16M 13/02 248/279.1 |
| 1,516,795 | A * | 11/1924 | Schwarting | A61G 13/12 248/118 |
| 1,625,682 | A * | 4/1927 | Ragg | A61G 13/1225 5/633 |
| 3,640,571 | A | 2/1972 | Keropian | |
| 4,073,537 | A | 2/1978 | Hammersburg | |
| 4,108,462 | A * | 8/1978 | Martin | B62J 1/08 248/286.1 |
| 4,313,639 | A * | 2/1982 | Ware | B60N 2/22 297/215.12 |
| 4,617,919 | A | 10/1986 | Suhre | |
| 4,813,746 | A * | 3/1989 | Mulholland | A61G 5/1091 297/464 |
| 5,362,082 | A | 11/1994 | Kornberg | |
| 5,582,464 | A | 12/1996 | Maymon | |
| 5,678,798 | A | 10/1997 | Little | |
| 5,964,439 | A | 10/1999 | Johnson | |
| 6,206,399 | B1 * | 3/2001 | Schnitzenbaumer | B62J 1/28 280/304.4 |
| 6,209,835 | B1 * | 4/2001 | Walrath | A47F 5/08 248/276.1 |
| 6,257,664 | B1 | 7/2001 | Chew et al. | |
| 6,361,118 | B1 | 3/2002 | Melgarejo et al. | |
| 6,378,947 | B1 | 4/2002 | Barber et al. | |
| 6,460,927 | B1 | 10/2002 | Groth | |
| 6,460,933 | B1 | 10/2002 | Bors et al. | |
| 6,840,577 | B2 | 1/2005 | Watkins | |
| 7,427,078 | B1 | 9/2008 | Humble et al. | |
| 7,866,613 | B2 | 1/2011 | Cramer | |
| 8,578,560 | B1 | 11/2013 | Swinehart et al. | |
| 8,596,719 | B2 | 12/2013 | Engman et al. | |
| 2007/0108829 | A1 | 5/2007 | Lehn et al. | |
| 2014/0265508 | A1 * | 9/2014 | Grant | A61G 5/125 297/411.38 |
| 2015/0123450 | A1 * | 5/2015 | Miller | A47C 16/00 297/488 |

FOREIGN PATENT DOCUMENTS

| | | | |
|---|---|---|---|
| DE | 202014000473 | U1 | 2/2014 |
| GB | 2459648 | A | 11/2009 |
| WO | 0141694 | A1 | 6/2001 |

OTHER PUBLICATIONS

Metalcraft Industries, Inc., Front Swing, Rear Swing, Slideaway, Lateral Thoracic Positioning, Product Information, PDF Created Feb. 23, 2011, 4 pages.

* cited by examiner

LATERAL SUPPORT ASSEMBLY

CROSS-REFERENCE TO RELATED APPLICATIONS

Not applicable.

STATEMENT OF FEDERALLY SPONSORED RESEARCH OR DEVELOPMENT

Not applicable.

BACKGROUND

This disclosure relates to a lateral support assembly for attachment to a wheelchair.

Lateral supports can be attached to the back of a wheelchair in order to provide an individual seated in the wheelchair with improved support on the sides of his or her trunk or torso, for example, in order to align the trunk above the pelvis. Conventionally, each lateral support is affixed to the back of the wheelchair or on one of the vertically-extending canes of the wheelchair on opposing lateral sides of the user. From the point of connection to the chair, each support then extends forwardly and medially to a support pad at the free end of the support. This pad is positioned for abutment to a side of the user.

Often, the lateral support includes some type of adjustable bracket between the point of connection of the support to the chair and the free end having the pad. This bracket can permit for the pad to be spatially positioned relative to the connection point on the wheelchair so that the pad appropriately contacts and supports the specific user's body based on the shape and size of the body.

Because the function of the lateral support is primarily to provide support, most lateral supports having brackets are not very dynamic in their forms of adjustment. Usually, the bracket merely consists of a series of metal plates fastened to one another via various fastener components (for example, bolts and corresponding nut type elements) in order to fix the plates in position relative to one another. In some instances, the lateral support may also have a single releasable hinge point to permit the pad to temporarily swing distally outward to accommodate loading or unloading of a user into the chair.

SUMMARY OF THE INVENTION

In prior art lateral support structures, there have been relatively few degrees of adjustment. Typically, one plate or bracket might be adjusted relative to another plate or bracket for positioning of the pad relative to the seated individual's torso. In some structures, there might be a single hinged bracket or pivot axis in order to permit some of the bracket structure or all of the bracket structure to swing out.

Disclosed herein are improved lateral support assemblies with greater degrees of adjustment. According to one aspect, the improved lateral support assembly implements a variable-unit link connection system in which one or more links are chained together in order to establish a link sub-structure that connects a mounting portion of the lateral support assembly to a pad support portion of the lateral support assembly. The number of links can be variable, as well as the angles at which the link(s) is/are arranged relative to one another to provide for outstanding flexibility in the positioning of the pad relative to the mounting portion. According to another aspect, the disclosed lateral support assembly may include two swing-away joints such that either (1) the pad support portion may be pivoted relative to the link sub-assembly and connected mounting portion or (2) the pad support portion plus the link sub-assembly may be pivoted relative to at least a part of the mounting portion. Further, in some forms, the improved lateral support assembly combines a forwardly sliding adjustment in the mounting portion of the assembly with the variable link sub-structure (having variable numbers of links and a variable-angled adjustment link structure) to provide improved adjustability.

According to one aspect of the invention, a lateral support assembly is disclosed for attachment to a wheelchair. The lateral support assembly includes a mounting portion for attachment to the wheelchair, a pad support portion for attachment to a pad, and a link sub-assembly including one or more links that connect the mounting portion to the pad support portion via their respective connection ends. The mounting portion includes an attachment part, a hinged part, and a sliding part. The attachment part is adapted to be affixed to the wheelchair and the hinged part is connected to the attachment part and is selectively pivotable about a first rotational axis. The sliding part is connected to the hinged part and is selectively extendable relative to the hinged part to forwardly extend a first distal connection end of the sliding part away from the attachment part. The pad support portion includes a pad bracket coupled to a secondary housing in which the pad bracket is selectively pivotable about a second rotational axis. This secondary housing has a second distal connection end for connection to the link sub-assembly.

As some non-limiting examples, it is contemplated that the attachment part may be adapted to be directly mounted to the back of the wheelchair, may be adapted to be mounted to a track of the wheelchair, or may be adapted to be mounted to a cane of the wheelchair. In some forms, the attachment part may be fastened directly to the wheelchair; however it is contemplated that the attachment part may also include other forms of attachment such as, for example, a clamping mechanism.

In some forms, the mounting portion of the lateral support assembly may include a first quick-release mechanism and the pad support portion of the lateral support assembly may include a second quick-release mechanism. The first quick-release mechanism may selectively hold the mounting portion in a first locked position in which the hinged part is rotationally fixed relative to the attachment part until the first quick-release mechanism is activated. When the first quick-release mechanism is activated, the mounting portion may be released from the first locked position such that the hinged part is rotatable relative to the attachment part about the first axis of rotation. The second quick-release mechanism may selectively hold the pad support portion in a second locked position in which the pad bracket is rotationally fixed relative to the secondary housing until the second quick-release mechanism is activated. When the second quick-release mechanism is activated, the pad support portion may be released from the second locked position such that the pad bracket is rotatable relative to the secondary housing about the second axis of rotation. Because the lateral support assembly offers dual-swing away capability, the first axis of rotation and the second axis of rotation can be spaced apart from one another, but may also be parallel with one another.

In some of the specific forms of the quick release mechanisms, each of the quick-release mechanisms may include a locking key interposed between the respective parts to which the key lock (that is, the attachment part and the hinged part in the mounting portion and the secondary housing and the pad bracket in the pad support portion). Each of the locking keys may be movable between a seated position in which the respective parts are coupled together to prevent their rotation relative to one another and a released position in which the respective parts are pivotable relative to one another about their respective axis of rotation. Each quick-release mechanism may include a biasing spring that biases the locking key into the seated position and may further include a depressible button that is connected to the locking key and is depressible to overcome a biasing force of the biasing spring to move the locking key from the seated position to the released position. In the instance of the first quick-release mechanism, the first rotational axis may be parallel with and extend through the depressible button. However, in the instance of the second quick-release mechanism, the pad bracket and the secondary housing may have a pivot pin positioned therebetween that join the pad bracket and the secondary housing together in which the second axis of rotation extends through the pivot pin and a central axis of the depressible button is parallel with, but spaced from, the second axis of rotation (that is to say, the pivot pin may be offset from the depressible button of the second quick-release mechanism).

In terms of the number of links, there may only be a single link connecting the mounting portion to the pad support portion or there may be a plurality of links connecting the mounting portion to the pad support portion. If there is more than one link, then the links may be in series with one another.

In some forms of the lateral support assembly, the assembly may include a plurality of fasteners that selectively fix the link(s) in position relative to the first distal connection end of the sliding part of the mounting portion and that positionally fix the link(s) in position relative to the second distal connection end of the secondary housing of the pad support portion. These fasteners may further positionally fix a first link relative to a second link (that is to say, the various links may be fixed with respect to one another via the fasteners).

The links may connect to one another or to the distal connection ends in a number of different ways. In some forms, the link(s) may be formed to have a deformable clamping section having two opposing sides that, upon tightening by one of the plurality of fasteners, move the two opposing sides closer together. In other forms, the link(s) may include a serrated interface that contacts a serrated interface of another component (for example, another link or a distal connection end of the mounting portion or the pad support portion) to which the link(s) is/are joined so that, upon fastening, the serrated interfaces maintain a positional and/or angular alignment of the link(s) and the other component.

In some forms, the sliding part may be selectively fixed in place relative to the hinged part by a fastener (such as, for example, a set screw that is tightened to press the components together).

The lateral support assembly may also include the pad itself, which can be attached to the pad support portion and a pad mount, in particular. The pad bracket may include the pad mount for selective attachment to the pad and a connecting arm may connect the pad mount to the secondary housing. The connecting arm may have a ball joint on one end thereof that is clamped to the pad mount by a clamping plate and may further have a hinged joint on the other end thereof that is connected to the secondary housing by a pivot pin.

As noted above, these various structures can provide a lateral support assembly having outstanding adjustability including dual swing-away capability, forward-extendability via the sliding parts, and improved flexibility via the modular link sub-assembly.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION

Figure 1:
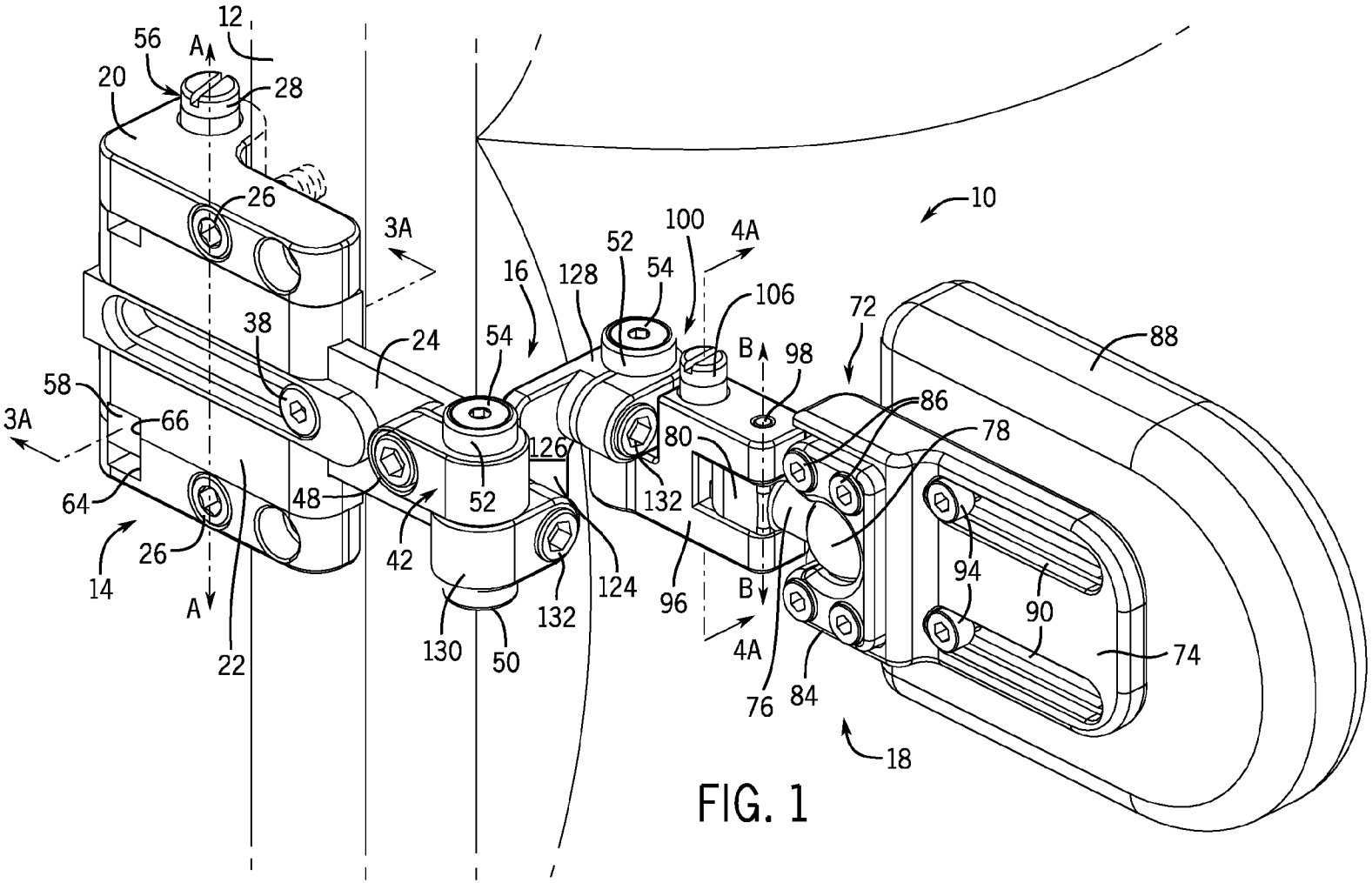
FIG. 1 is a perspective view of a lateral support assembly according to one aspect of the invention in which the lateral support assembly is attached to a back of a wheelchair.

Looking first at FIG. 1, a lateral support assembly 10 according to one form of the invention is illustrated attached to a back of a wheelchair 12. A lateral support assembly 10 of this type is typically used to support the torso of an individual seated in the chair so as to maintain that individual's torso above their pelvis. However, it is contemplated that the structure of the lateral support assembly may also be used in other types of support assemblies or brackets.

The lateral support assembly 10 can be conceptually sub-divided into three portions including a mounting portion 14, a link sub-assembly 16, and a pad support portion 18. The elements of each of these portions and their connectivity to one another will now be separately described.

Figure 2A:
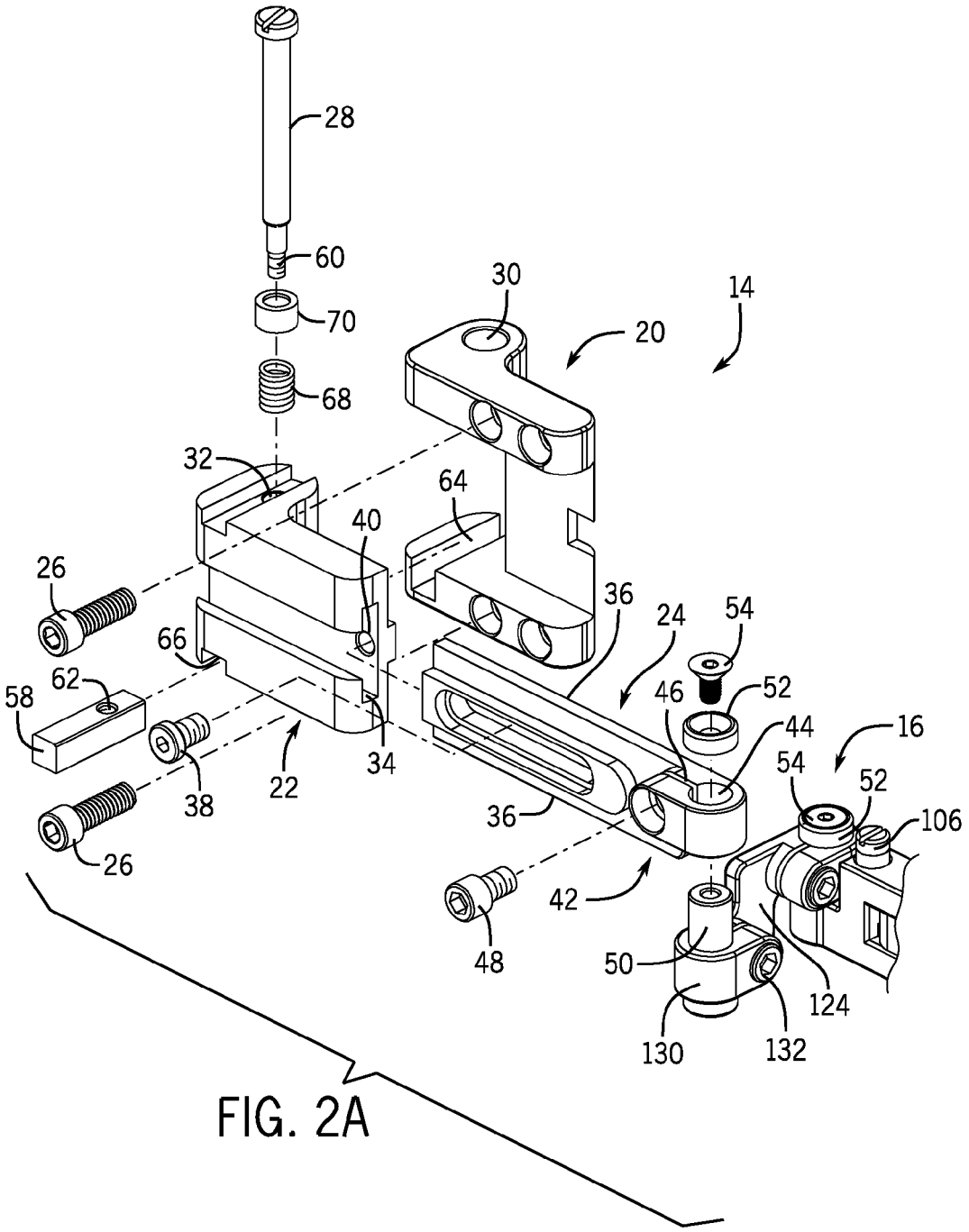
FIG. 2A is an exploded view of the mounting portion of the lateral support assembly of FIG. 1 illustrating many of the various parts thereof.

With additional reference to FIG. 2A, an exploded view of the mounting portion 14 of the lateral support assembly 10 is illustrated to show its various components. The mounting portion 14 includes three main parts including an attachment part 20, a hinged part 22 and a sliding part 24.

The attachment part 20 is adapted to be fixedly connected to the wheelchair 12 by using bolts 26 or other fasteners. Although fasteners are illustrated as being used to connect the attachment part 20 to the wheelchair 12, it will be appreciated that various other forms of attachment including, for example, clamps or clamping mechanisms may be used to make this attachment instead.

In the form illustrated, the hinged part 22 is centrally received or nested in the attachment part 20 in a recessed channel or space between connected upper and lower segments of the attachment part 20 through which the mounting bolts 26 are secured. The attachment part 20 and the hinged part 22 are pivotally connected together by a first depressible button 28 having a shaft-like body that vertically extends through openings 30 in the attachment part 20 and through openings 32 in the hinged part 22 along a first axis of rotation A-A. The shaft-like body of the first depressible button 28 provides bearing surfaces that contact the openings 30 and 32 such that the body of the button 28 effectively acts as a pivot pin. It should be noted that this point of pivotal connection and the first axis of rotation A-A is at a rearward end of the mounting portion 14 such that, when the hinged part 22 rotates relative to the fixed attachment part 20, the hinged part 22 swings laterally outward from the chair 12 and slightly backwards.

Figure 5:
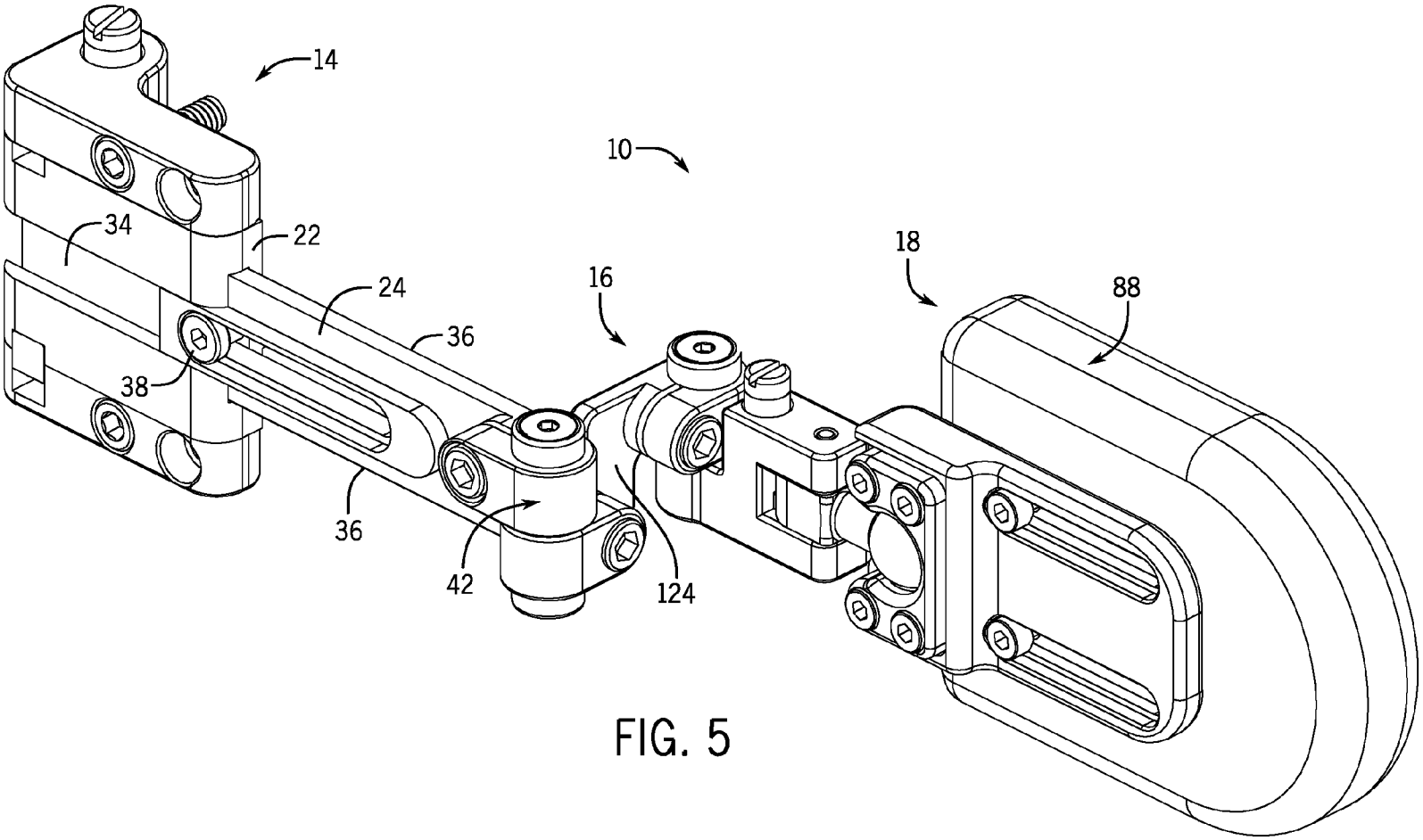
FIG. 5 shows the lateral support assembly in which the sliding part of the mounting portion is extended forwardly from the pivoting part of the mounting portion to extend the pad forward relative to the mounting portion.

The hinged part 22 has a grooved track 34 formed in it that extends horizontally in forward and backward directions. Oppositely facing rails 34 on the top and bottom edges of the sliding part 24 are received in the grooved track 34 such that the sliding part 24 can slide or move forward or backward relative to the hinged part 22. A screw 38 can be used, once the sliding part 38 is slid into the desired position with respect to the hinged part 33 to lock the two parts in place with respect to one another by engaging a threaded hole 40 in the hinged part 22 to clamp the sliding part 24 into place. This extension of the sliding part 24 relative to the hinged part 22 is illustrated in FIG. 5, for example, to extend the pad 88 forward relative to the mounting portion 14. In this regard, when the screw 38 locks the hinged part 22 and the sliding part 24 together, when the hinged part 22 is rotated relative to the attachment part 20, the sliding part 24 rotates with the hinged part 22 about the first axis of rotation A-A.

The sliding part 24 has a first distal connection end 42 to which the link sub-assembly 16 is attached. In the particular form illustrated, the first distal connection end 42 includes a deformable clamping section having a looped opening 44 adjacent a split slot 46. By tightening a fastening screw 48, the split slot 46 can be narrowed to adjust the size of the average diameter of the looped opening 44. When a closely undersized shaft or pin is received in this looped opening 44 (by for example, threading a post or a pin 50 and capping it with a washer 52 and screw 54 to maintain the pin 50 it in place), this tightening can be used to close the looped opening 44 slightly to deform it and frictionally capture the undersized pin 50 in position.

At this point, the other components in the exploded view of FIG. 2A will be described that form a part of a first quick-release mechanism 56 illustrated more fully in FIGS. 3A and 3B. Among the components of the first quick-release mechanism 56 are the first locking key 58 which is rectangular. A threaded bottom end 60 of the first depressible button 28 is received into an upwardly-facing threaded opening 62 on the first locking key 62 to connect the first locking key 58 and the first depressible button 28 together. This locking key 58 is interposed between the attachment part 20 and the hinged part 22 and is movably positioned in facing slots 64 and 66 thereof, respectively, therebetween. The first quick-release mechanism 56 also includes a first biasing spring 68 and a collar 70 that are telescopically received around the upper end of the first depressible button 28 between the top end of the button 28 and attachment part 20.

Figure 2B:
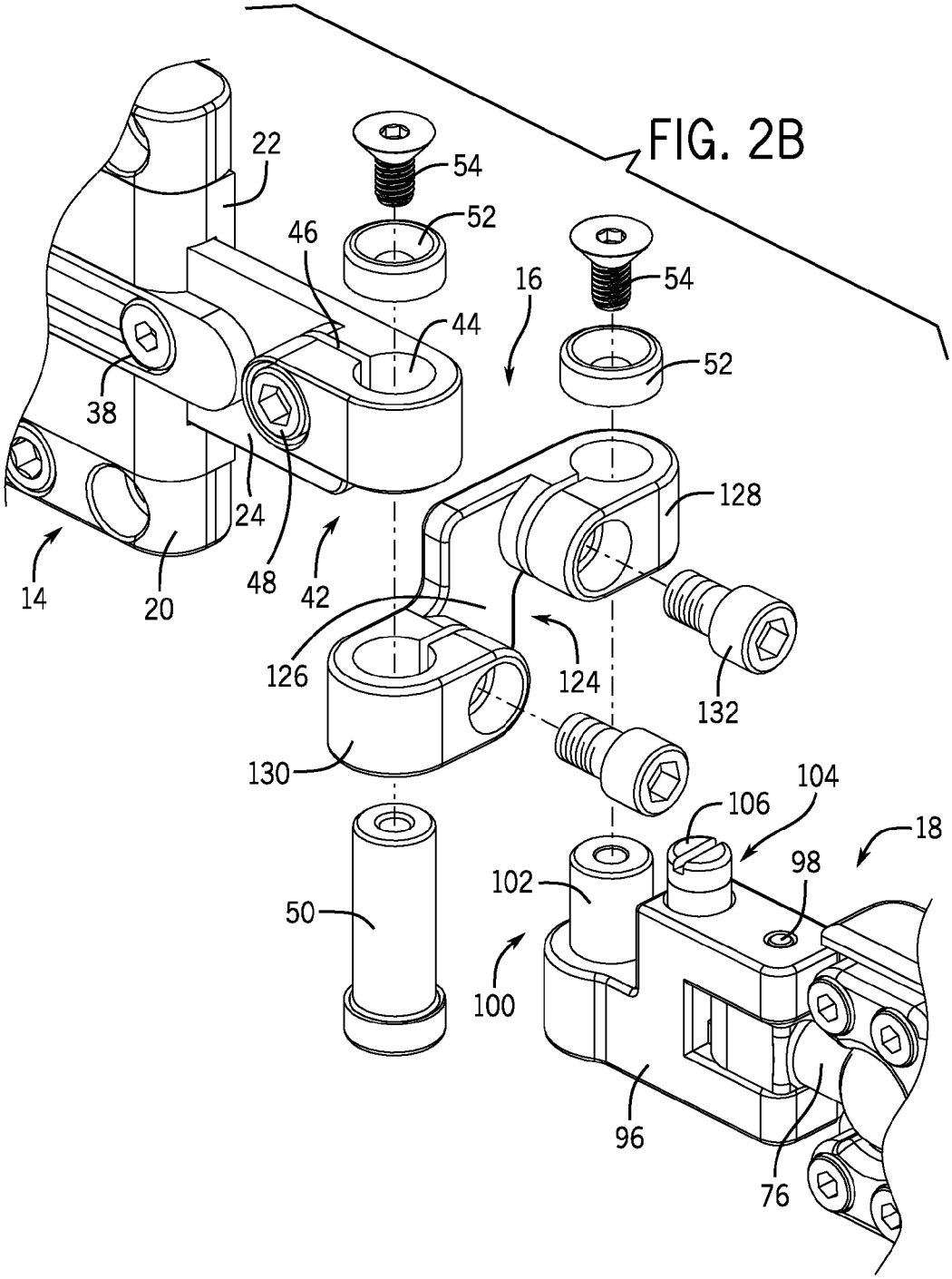
FIG. 2B is an exploded view of the link sub-assembly of the lateral support assembly of FIG. 1 connecting the mounting portion to the pad support portion and illustrating many of the various parts thereof.
Figure 2C:
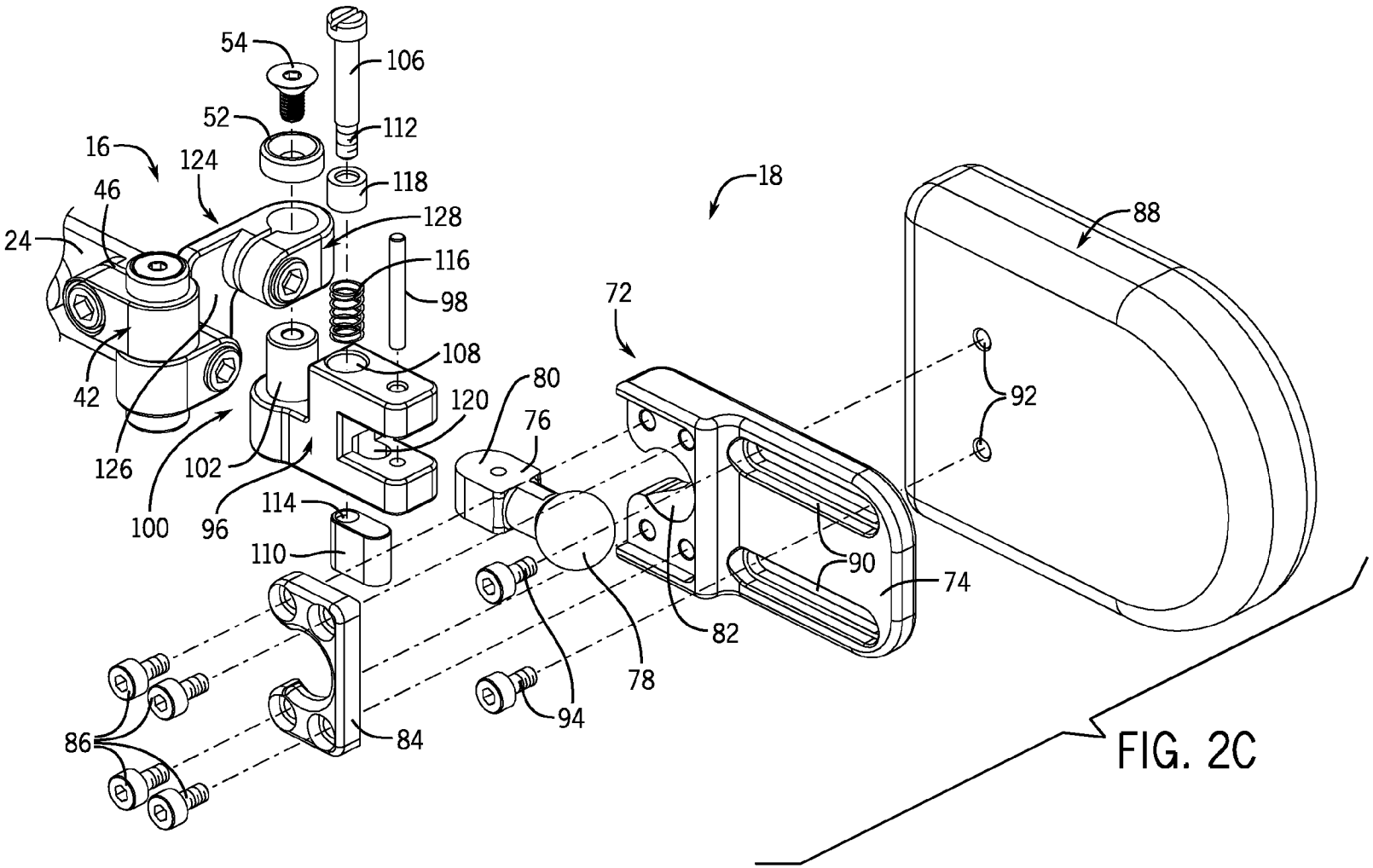
FIG. 2C is an exploded view of the pad support portion of the lateral support assembly of FIG. 1 illustrating many of the various parts thereof.

Briefly advancing forward to FIG. 2C, the pad support portion 18 is now illustrated in an exploded fashion to detail its various components.

The pad support portion 18 includes a pad bracket 72 which includes a pad mount 74 and a connecting arm 76. The connecting arm 76 has a ball joint 78 on one end thereof and a hinged joint 80 on the other end thereof. The ball joint 78 is clamped into a circular recess 82 on the pad mount 74 by a clamping plate 84 which is fastened to the pad mount 74 by a set of fasteners 86 to capture the ball joint 78 between the pad mount 74 and the clamping plate 84.

A pad 88 can be attached to the pad mount 74. In the form illustrated, the pad mount 74 has a pair of horizontally-extending slots 90 formed therein and there are a pair of corresponding mounting holes 92 on the back side of the pad 88. A pair of screws 94 extends through the back side of the pad mount 74, through the slots 90, and into the mounting holes 92 on the back of the pad 88. To fix the pad 88 in position on the pad mount 74, these screws 94 are tightened. If it is necessary to re-position the pad 88 relative to the pad mount 74, the screws 94 may be loosened, the location of the pad 88 may be adjusted relative to the pad mount 74 (likely in a direction of linear translation), and the screws 94 tightened back down. It will be appreciated that this form of pad attachment is only by way of example and other ways of pad attachment (for example, frictional, adhesive, magnetic, and other forms of mechanical attachment) are also contemplated.

The pad support portion 18 further includes a secondary housing 96. The secondary housing 96 is linked by a vertically-extending pivot pin 98 to the hinged joint 80 side of the connecting arm 76. This pivot pin 98 establishes a second axis of rotation B-B for the dual swing-away functionality. In the embodiment shown, the secondary housing 96 also includes a second distal connection end 100 having an upwardly extending post 102 that is adapted for connection to the link sub-assembly 16.

Further, the components for a second quick-release mechanism 104 (operation of which is detailed in FIGS. 4A and 4B) are illustrated in FIG. 2C. These components include a second depressible button 106 which vertically extends into an opening 108 in the secondary housing 96, a second locking key 110 which has a bottom end 112 of the second depressible button 106 threaded into an opening 114 in a top face thereof, and a second biasing spring 116 and a collar 118 which are telescopically received on a top end of the second depressible button 106 between the top end of the button 106 and the secondary housing 96. There is a slot 120 formed in the secondary housing 96 and a slot 122 formed in the hinged joint 80 of the connecting arm 76 that receive the second locking key 110.

The second quick-release mechanism 104 differs slightly from the first quick-release mechanism 56 in that the slots 120 and 122 are both open to the bottom side and the second locking key 110 is placed into this open space. Thus, rather than having the key captured between an upper and lower surface of the two parts as in the first quick-release mechanism 56, the second locking key 110 in the second quick-release mechanism 104 is not confined on the bottom side. However, the second locking key 110 does not fall out because it is threaded to the second depressible button 106.

Now turning to FIG. 2B, one representative link 124 for the link sub-assembly 16 is illustrated. The link 124 has a main body 126 that supports two connecting ends 128 and 130 on opposing horizontal ends. It is noted that one of the connecting ends 128 near the forward end of the link 124 is disposed on the top half, vertically, of the link 124, whereas the other one of the connecting ends 130 near the rearward end of the link 124 is disposed on the bottom half, vertically, of the link 124. This or another repeatable-type structural arrangement permits for the link 124 to be chained to other links of a similar type (as will be described in more detail below with respect to FIG. 6).

Each of these connecting ends 128 and 130 have a deformable looped opening in a manner similar to the first distal connection end 42 on the sliding part 24. Again, fasteners, such as fasteners 132 can be tightened to reduce the average diameter of the deformable looped opening to grip a slightly undersized shaft or pin received therein.

Still referring to FIG. 2B and with additional reference being made to the first distal connection end 42 and the second distal connection end 100 in FIGS. 2A and 2C, respectively, it is shown in detail how the link sub-assembly 16 connects the first distal connection end 42 of the sliding part 24 of the mounting portion 14 to the second distal connection end 100 of the secondary housing 96 of the pad support portion 18. During connection and as best illustrated in FIG. 2B, the looped opening of the forward connecting end 128 of the link 124 is received over the post 102 on the second connecting end 128 of the secondary housing 96 of the pad support portion 18. One of the washers 52 and fasteners 54 are screwed into the top of the post 102 to retain the link 124 on the post 102. Additionally, one of the pins 50 is inserted into and through the looped opening at the rear connecting end 130 of the link 124 and the looped opening 44 at the first distal connecting end 42 of the sliding part 24 of the mounting portion 14. Another one of the washers 52 and screws 54 are used to cap the pin 50 on the top side, so as to capture the pin 50 between the sliding part 24 and the link 124. The angular orientation of the link 124 relative to the sliding part 24 and the secondary housing 96 are established and then the screws/fasteners 48 and 132 are fastened to close the looped openings around the pin 50 and post 102. Similarly, the screws 54 are tightened to the pin 50 and the post 102 to fix the sliding part 24, the secondary housing 96, and link 124 in position relative to one another.

Figure 6:
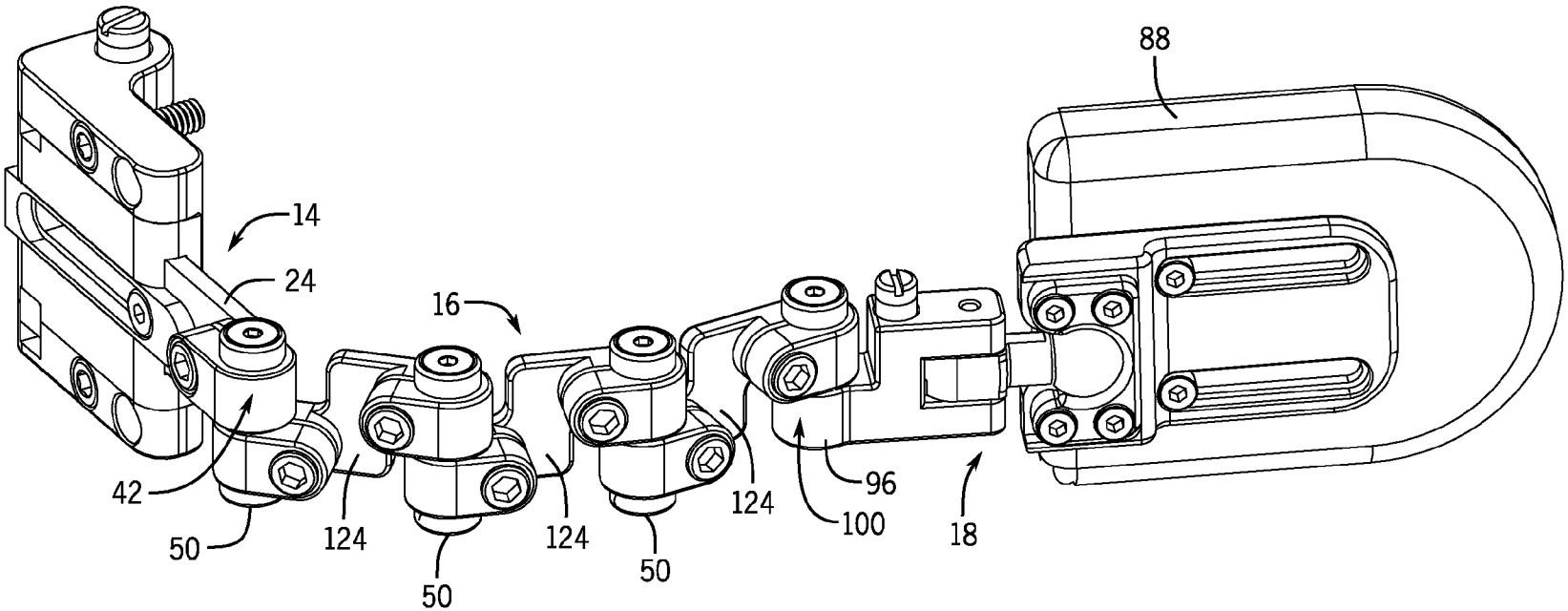
FIG. 6 is a perspective view of the lateral support assembly of FIG. 1 in which multiple links (specifically, three links), instead of just a single link, are used to connect the mounting portion of the assembly to the pad support portion of the assembly.

With forward reference being made to FIG. 6, it can be seen that in some forms, there may be multiple links 124 chained together in series. In order to add another link 124 to the chain of links 124 in the link sub-assembly 16, the forward connecting end 128 of one link 124 can be connected to the rear connecting end 130 of another link, for example, by using a pin 50 in conjunction with a washer 52 and screw 54. In this way, one link can be joined to another to form the link sub-assembly 16 in which one of the terminal ends of the link sub-assembly 16 includes an available rear connecting end 130 for attachment to the first distal connection end 42 on the sliding part 24, while the other of the terminal ends of the link sub-assembly 16 includes an available forward connecting end 128 for attachment to the second distal connection end 100.

It will be appreciated that the various connecting ends may have a style or arrangement different from that illustrated in the first embodiment. For example, a post might be disposed on the first distal connection end on a sliding part, while a looped opening might be formed on the second distal connection end of a secondary housing. In this example, the respective types of terminal ends on the link sub-assembly may be reversed to reflect to alteration.

Figure 7:
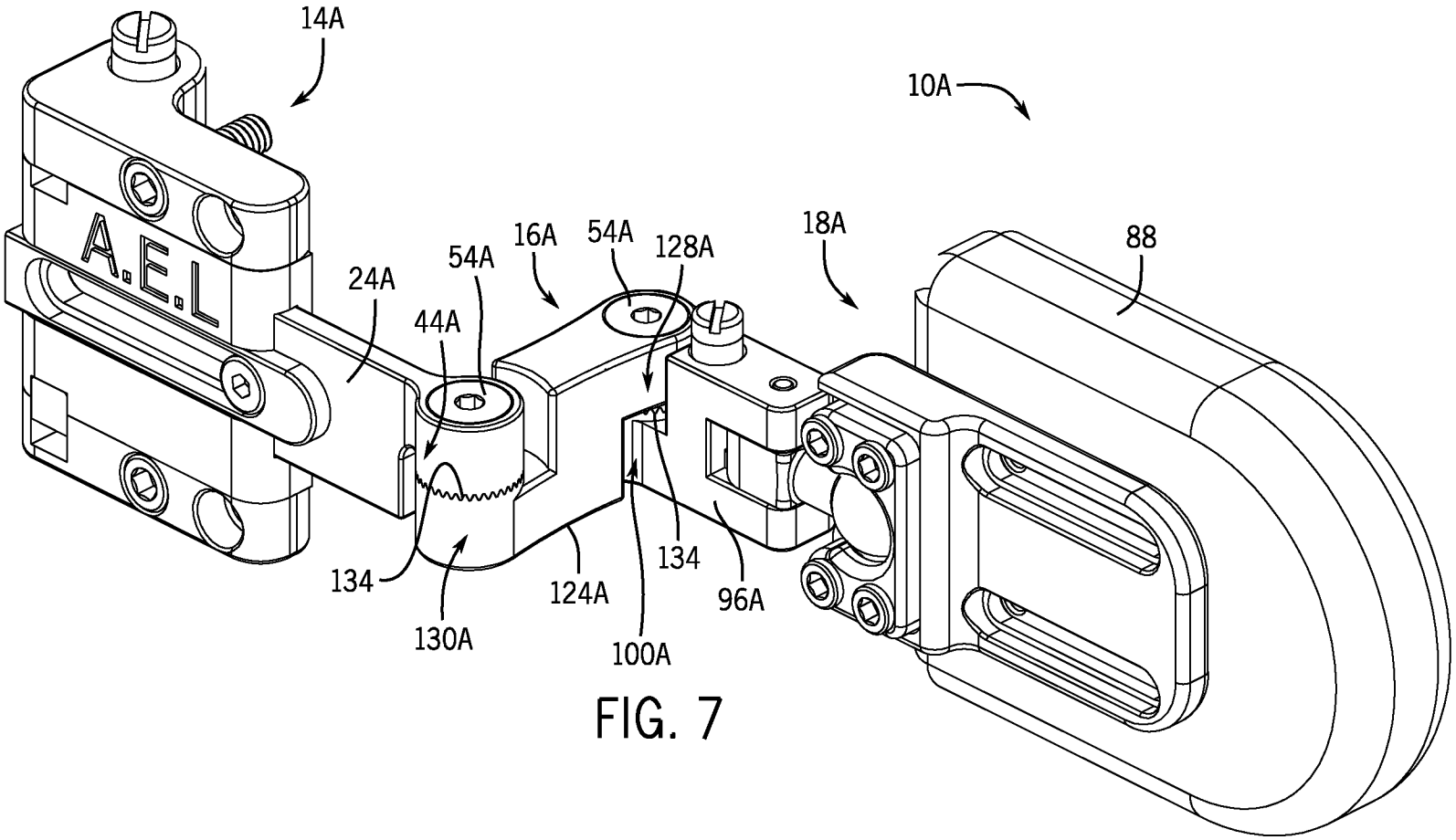
FIG. 7 is a perspective view of an alternative form of the lateral support assembly in which the facing surfaces of the links are serrated to assist with angularly locking the joined components relative to one another.

Further, it is contemplated that the link sub-assembly and the connecting system may have an entirely different form than the pin and compressive loop type connections that are illustrated in the first exemplary embodiment. With forward reference to FIG. 7, a second exemplary embodiment is illustrated in which the connection type is changed from the pin and compressive loop type connections to a connection type in which serrated interfaces are used to join the various components together. More specifically, the lateral support assembly 10A again has a mounting portion 14A, a pad support portion 18A supporting the pad 88, and a link sub-assembly 16A that connects the mounting portion 14A to the pad support portion 18A. However, in the lateral assembly 10A in FIG. 7, various connection parts have serrated interface surfaces 134 which extend radially inward from the illustrated edges. These serrated interface surfaces 134 are located at the first distal connection end 44A of the sliding part 24A, at the forward and rear connecting ends 128A and 130A of the link 124A, and at the second distal connection end 100A of the secondary housing 96A. Screws or other fasteners 54A can be used to lock the various connected components together, once the serrated interfaces 134 of the components to be joined have been engaged with one another at the desired angle and orientation. Although not illustrated, it will again be appreciated that the links 124A in this serrated style of connection may be chained together for improved flexibility and adjustability in a manner similar to that illustrated in FIG. 6.

Turning now to FIGS. 3A through 3C and 4A through 4C, the first quick-release mechanism 56 in the mounting portion 14 and the second quick-release mechanism 104 in the pad support portion 18 are illustrated, respectively, in a manner that shows their operation. Effectively, these quick-release mechanisms 56 and 104 establish two lock-and-release points such that the lateral support assembly 10 has dual swing-away ability in which the pad 88 can be rotated away from the body of the seated user at either axis of rotation A-A or B-B.

Figure 3B:
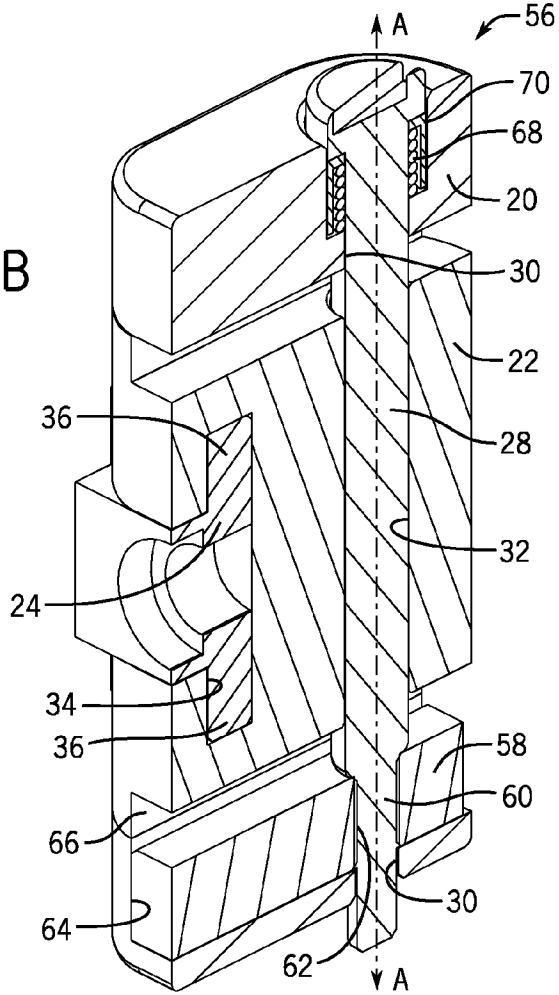
FIG. 3B is a cross-sectional view of the mounting section similar to FIG. 3A, but in which the first quick-release mechanism has been moved to the released position.
Figure 3A:
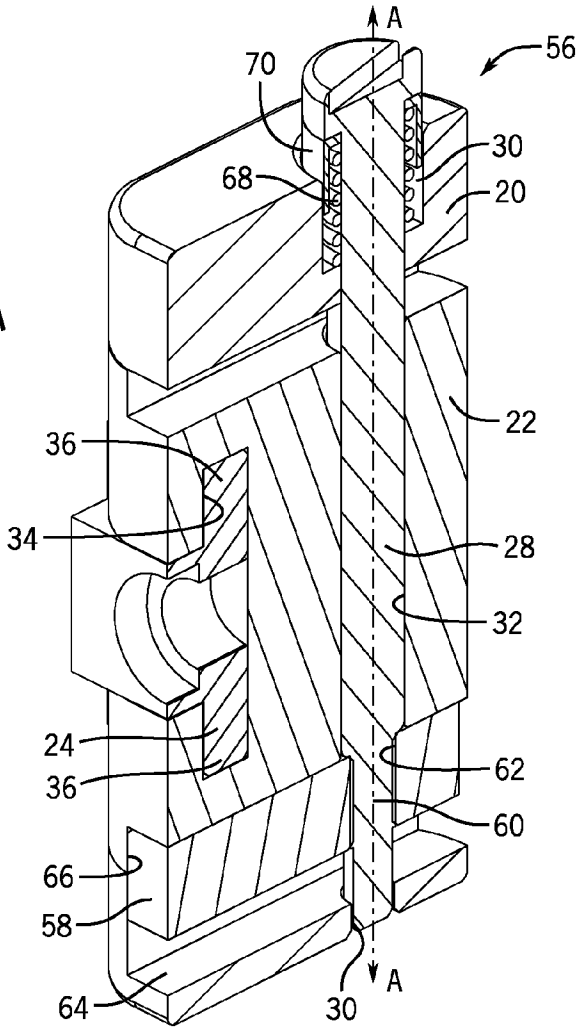
FIG. 3A is a cross-sectional view of the mounting section of the lateral support assembly taken through line 3A-3A of FIG. 1 showing the first quick-release mechanism in the locked position.

In FIGS. 3A and 3B, cross sections are taken through the first quick-release mechanism 56 to show the first quick-release mechanism 56 in the locked and released positions, respectively.

FIG. 3A shows the first quick-release mechanism 56 in the locked position, which is also consistent with the illustration of FIG. 1. In the locked position, the first biasing spring 68 causes the first depressible button 28 to be urged upwards as well as the first locking key 58 attached to the bottom end of the first depressible button 28. In this position, the first locking key 58 is shown to be positioned between the facing slots 64 and 66 of the attachment part 20 and the hinged part 22 so as to create interference if one were to attempt to rotate the hinged part 22 relative to the attachment part 20 about axis A-A. Thus, under non-depressed conditions, the attachment part 20 and the hinged part 22 are rotationally locked at the position depicted in FIG. 1.

In order to unlock the first quick release mechanism 56, the first depressible button 28 is pressed and displaced downwards along axis A-A. This causes the attached first locking key 58 to be forced downwards entirely into the slot 64 of the attachment part 20 and to be removed from the slot 62 in the hinged part 22. In this released position, the first locking key 58 does not interfere with or block the rotation of the hinged part 22 about the attachment part 20.

Figure 3C:
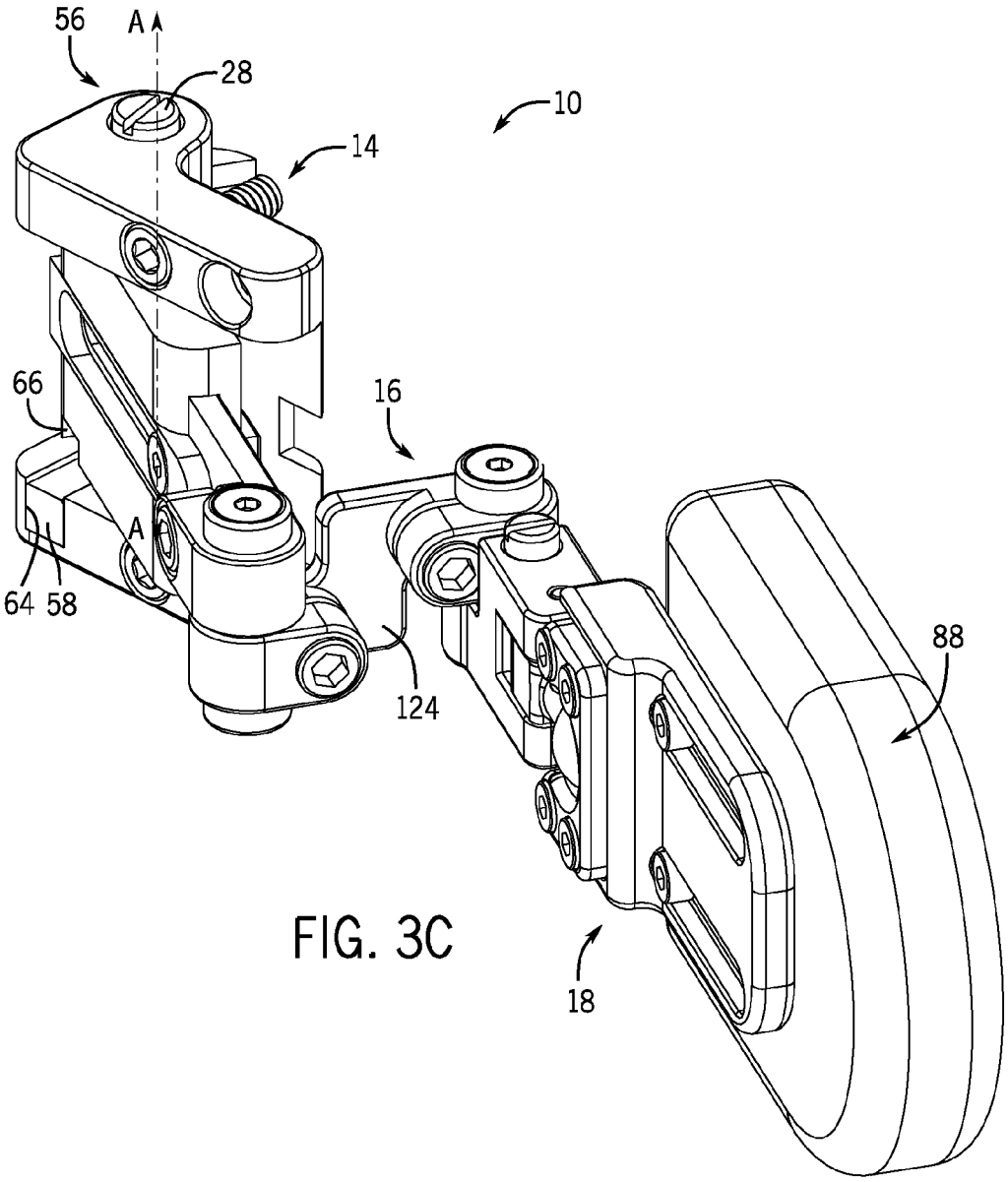
FIG. 3C is a perspective view in which, due to the release of the first quick-release mechanism, all of the lateral support assembly (except for the attachment part of the mounting portion) is permitted to rotate relative to a first rotational axis.

With the first quick-release mechanism 56 in the released position due to the depression of the button 28, the lateral support assembly 10 is able to rotate about axis A-A relative to the attachment part 20 as illustrated in FIG. 3C. As the attachment part 20 is fixed relative to the wheelchair 12, this means that, effectively, the entirety of the lateral support assembly 10 (except for the attachment part 20 and portions of the first quick release mechanism 56) is able to swing laterally away from the wheelchair 12 about axis A-A when the first locking key 58 is moved to the released position. If the first depressible button 28 is released and the attachment part 20 and the hinged part 22 are positioned such that their slots 64 and 66 align with one another again, then the first locking key 56 will snap or be biased back into the locking position.

Figure 4B:
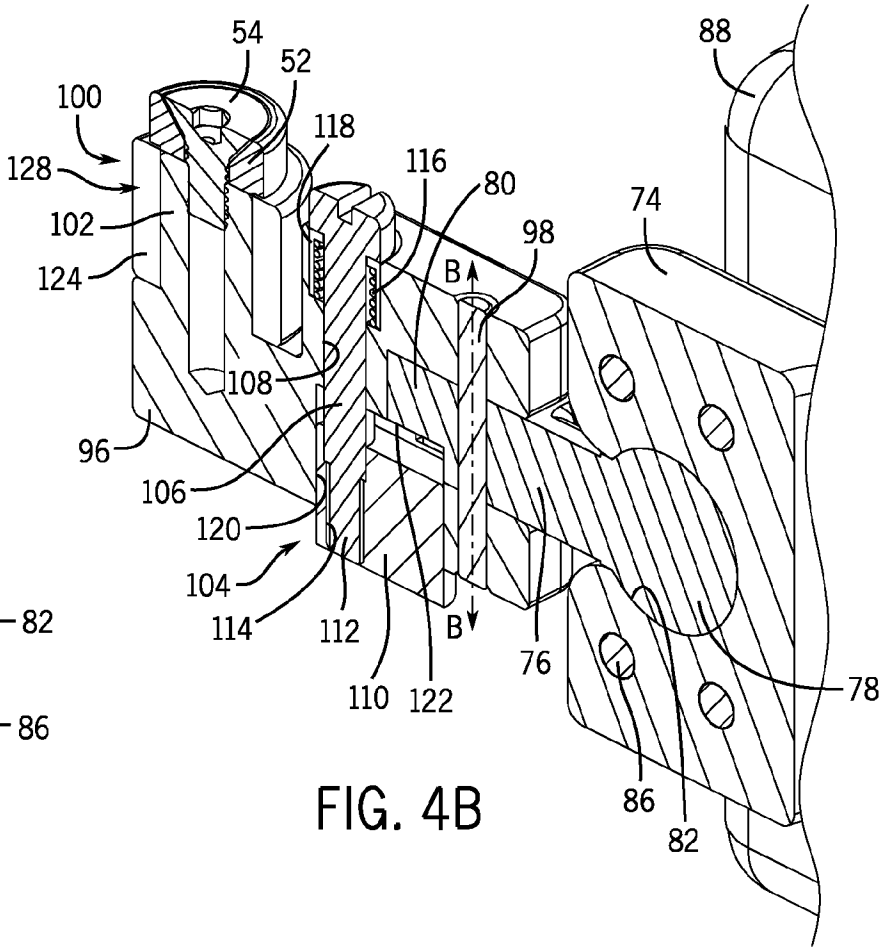
FIG. 4B is a cross-sectional view to FIG. 4A, but in which the second quick-release mechanism has been moved to the released position.
Figure 4A:
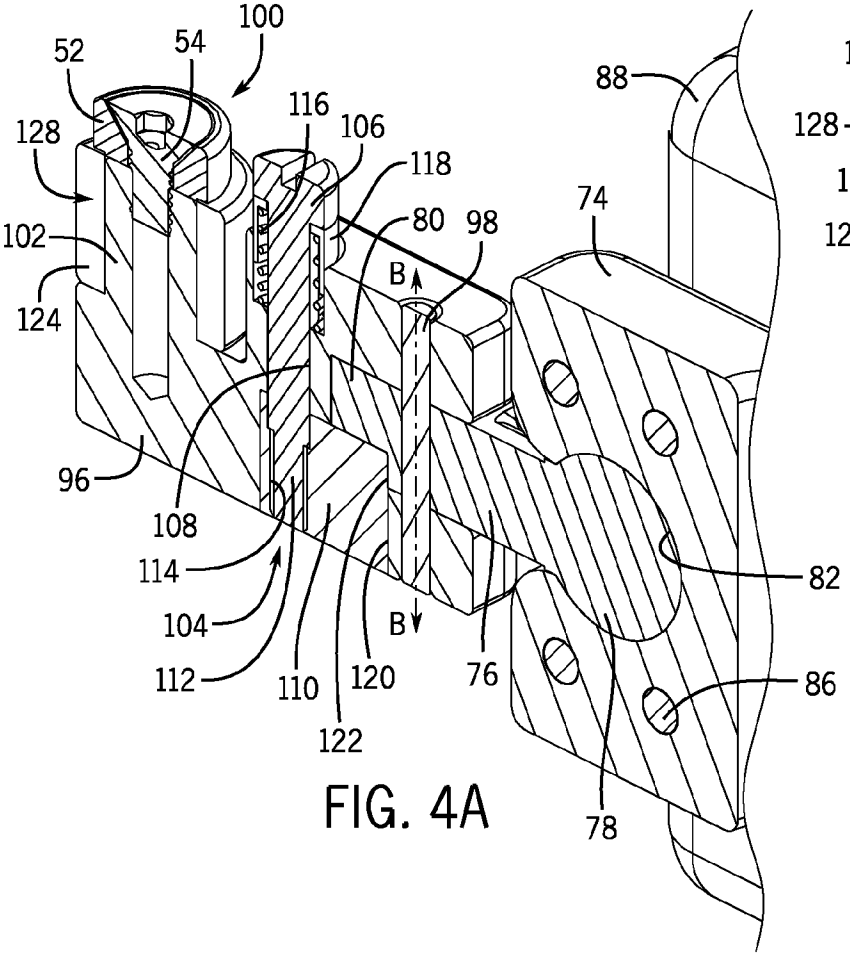
FIG. 4A is a cross-sectional view taken through line 4A-4A of FIG. 1 showing the second quick-release mechanism in the locked position.

Turning now to FIGS. 4A and 4B, cross sections are taken through the second quick-release mechanism 104 to show the second quick-release mechanism 104 in the locked and released positions, respectively.

Figure 4C:
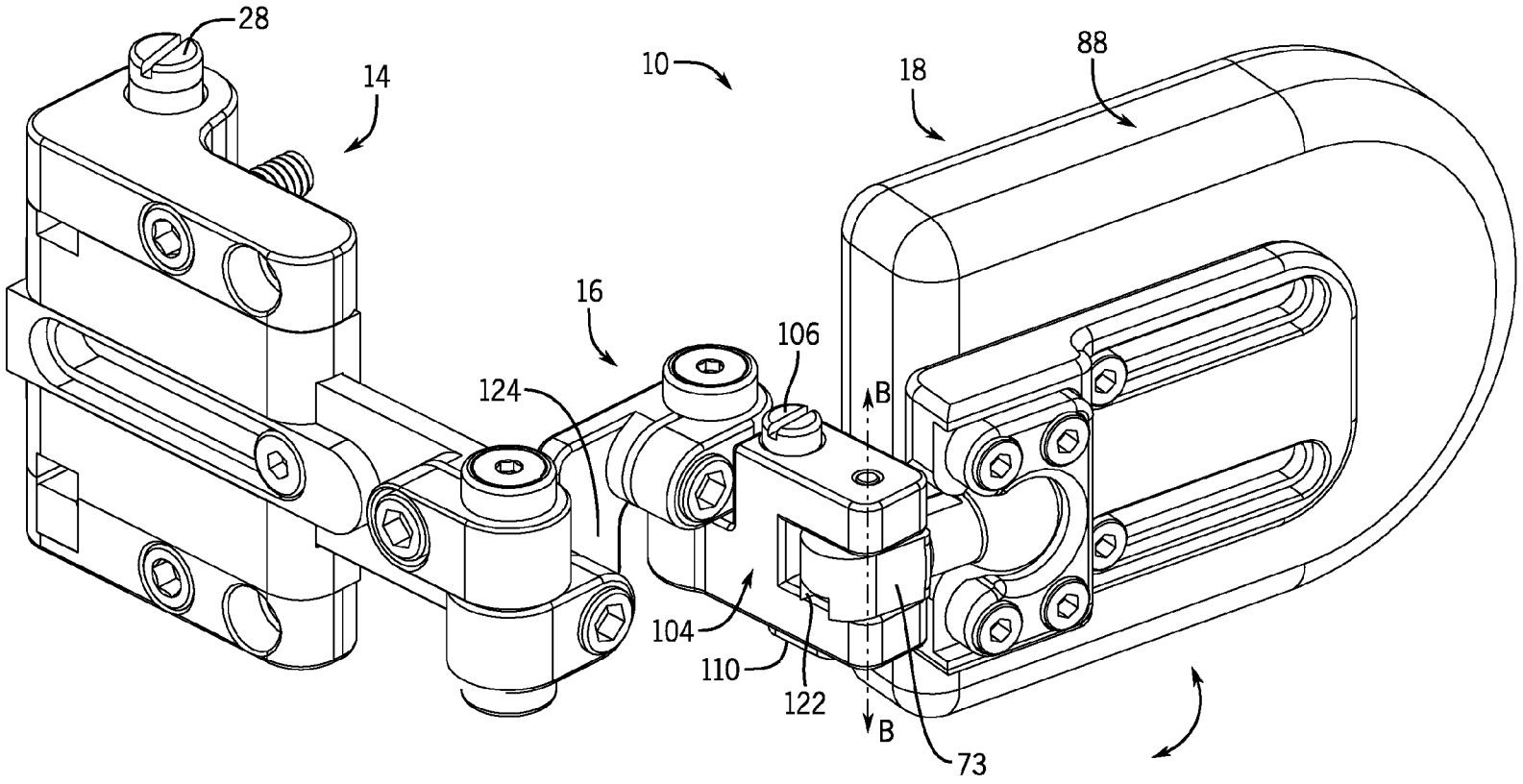
FIG. 4C is a perspective view in which, due to the release of the second quick-release mechanism, all of the pad support portion is permitted to rotate relative to the rest of the lateral support assembly about a second rotational axis.

The general principle of operation of the second quick-release mechanism 104 is similar to that of the first quick-release mechanism 56 in that, in the locked position illustrated in FIG. 4A in which the second depressible button 106 and the second locking key 110 are urged upward by the second biasing spring 116, the second locking key 110 is positioned between slots 120 and 122 in the secondary housing 96 and the connecting arm 76. However, they are different in that, when the second depressible button 106 is depressed to move the second locking key 110 downward into the released position, the second locking key 110 is cleared from the slot in the connecting arm 76. With the second locking key 106 being removed from the slot 122 in the connecting arm 76, the connecting arm 76 is rotatable about axis B-B, defined by the pivot pin 98, relative to the secondary housing 96. FIG. 4C illustrates one direction of rotation of the pad bracket 72 (including the connecting arm 76 and the pad mount 74) and the attached pad 88, relative to the rest of the assembly 10 and the mounting portion 14.

In FIG. 4C, the pad 88 is illustrated as being medially rotated to a position that would be into the torso of the user. This view is made primarily to illustrate the slot 122 in the connecting arm 76, which is otherwise not well illustrated in the other views. However, it will be appreciated that, under normal usage circumstances, the pad 88 will be swung laterally outward to establish a second swing away point about axis B-B.

It should be appreciated that FIGS. 3A-3C and 4A-4D illustrate but two examples of quick-release mechanisms. While these examples are provided to explain one way that the quick release functionality may be obtained, other types of quick release mechanisms may also be implemented in their place.

Figure 8:
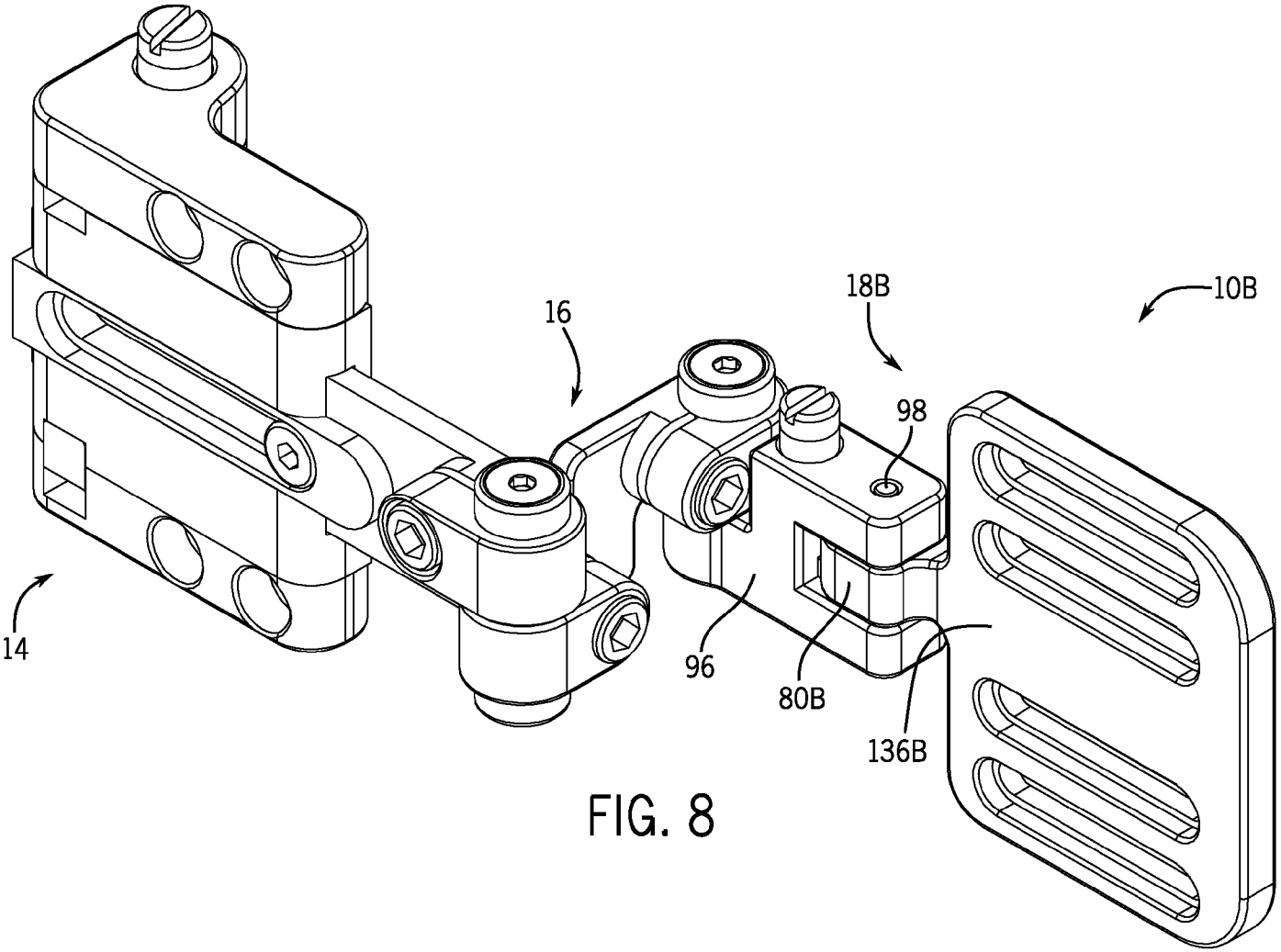
FIG. 8 is a perspective view of another alternative form of the lateral support assembly in which the pad bracket is a single piece (without the pad attached) is directly attached to the secondary housing instead of a separate pad mount and connecting arm as in the earlier figures.

Further, it will be appreciated that the pad bracket might be a single piece as illustrated in FIG. 8 rather than being multiple separate pieces (for example, a separate connecting arm 76 and pad mount 74) as illustrated in FIGS. 1 through 7. Looking at FIG. 8, in an alternative lateral support assembly 10B, the mounting portion 14 and the link sub-assembly 16 may be essentially the same as in first illustrated embodiment. However, the pad support portion 18B may be differently designed from the earlier embodiments in which the pad support portion 18 comprised multiple pieces. Instead, the pad bracket 136B of the lateral support assembly 10B is a single integrally-formed piece including the pad mount section and the attachment section (i.e., the hinged joint 80B). The hinged joint 80B is again attached to the secondary housing 96 via the pivot pin 98, but in this instance the pad mount section of the pad bracket 136B is not adjustable relative to the hinged joint 80B. Thus, in this arrangement without the ball-and-socket type joint, there is some reduction in the amount of flexibility of the orientation of the pad relative to the secondary housing 96; however, it will be appreciated that, by virtue of adjustment of the link sub-assembly 16, much of adjustability of the location of the pad is maintained without needing to add in the additional structure for a ball-and-socket type of connecting structure of the earlier embodiments.

Thus, a dual-swing away construction is illustrated in which the pad 88 can be swung away from the user in multiple ways for maximum control in access. Further, as described above, this lateral support assembly 10 possesses exceptional flexibility in that the link sub-assembly 16 is highly flexible in positioning and length. Still further, the forward motion of sliding part 24 presents yet another dimension of adjustment.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A lateral support assembly for attachment to a wheelchair, the lateral support assembly comprising:

a mounting portion for attachment to the wheelchair, the mounting portion including an attachment part adapted to be affixed to the wheelchair, a hinged part connected to the attachment part and selectively pivotable about a first rotational axis, and a sliding part connected to the hinged part in which the sliding part is selectively extendable relative to the hinged part to forwardly extend a first distal connection end of the sliding part away from the attachment part;

a pad support portion for attachment to a pad, the pad support portion including a pad bracket coupled to a secondary housing that has a second distal connection end, wherein the pad bracket is selectively pivotable about a second rotational axis; and a link sub-assembly comprising at least one link connecting the first distal connection end of the sliding part of the mounting portion to the second distal connection end of the secondary housing;

wherein the mounting portion comprises a mounting portion quick-release mechanism, the mounting portion quick-release mechanism including a locking key interposed between the attachment part and the hinged part, in which the locking key is movable between a seated position in which the attachment part and the hinged part are coupled together to prevent rotation of the hinged part relative to the attachment part and a released position in which the hinged part is pivotable relative to the attachment part about the first rotational axis.

2. The lateral support assembly of claim 1, wherein the pad support portion includes a pad support portion quick-release mechanism, wherein the mounting portion quick-release mechanism selectively holds the mounting portion in a first locked position in which the hinged part is rotationally fixed relative to the attachment part until the mounting portion quick-release mechanism is activated to release the mounting portion from the first locked position such that the hinged part is rotatable relative to the attachment part about the first axis of rotation, and wherein the pad support portion quick-release mechanism selectively holds the pad support portion in a second locked position in which the pad bracket is rotationally fixed relative to the secondary housing until the pad support portion quick-release mechanism is activated to release the pad support portion from the second locked position such that the pad bracket is rotatable relative to the secondary housing about the second axis of rotation.

3. The lateral support assembly of claim 2, wherein the first axis of rotation and the second axis of rotation are parallel with one another and spaced apart from one another.

4. The lateral support assembly of claim 1, wherein the mounting portion quick-release mechanism includes a biasing spring that biases the locking key into the seated position and further includes a depressible button that is connected to the locking key and is depressible to overcome a biasing force of the biasing spring to move the locking key from the seated position to the released position.

5. The lateral support assembly of claim 4, wherein the first rotational axis is parallel with and extends through the depressible button.

6. The lateral support assembly of claim 1, wherein the attachment part is adapted to be directly mounted to the back of the wheelchair, is adapted to be mounted to a track of the wheelchair, or is adapted to be mounted to a cane of the wheelchair.

7. The lateral support assembly of claim 1, wherein the at least one link is formed to have a deformable clamping section having two opposing sides that, upon tightening by one of a plurality of fasteners, move the two opposing sides closer together.

8. The lateral support assembly of claim 1, wherein the at least one link includes a serrated interface that contacts a serrated interface of another component to which the at least one link is joined so that, upon fastening, the serrated interfaces maintain a positional alignment of the at least one link and the other component.

9. The lateral support assembly of claim 1, wherein the sliding part is selectively fixed in place relative to the hinged part by a fastener.

10. A lateral support assembly for attachment to a wheelchair, the lateral support assembly comprising:

a mounting portion for attachment to the wheelchair, the mounting portion including an attachment part adapted to be affixed to the wheelchair, a hinged part connected to the attachment part and selectively pivotable about a first rotational axis, and a sliding part connected to the hinged part in which the sliding part is selectively extendable relative to the hinged part to forwardly extend a first distal connection end of the sliding part away from the attachment part;

a pad support portion for attachment to a pad, the pad support portion including a pad bracket coupled to a secondary housing that has a second distal connection end, wherein the pad bracket is selectively pivotable about a second rotational axis;

a link sub-assembly comprising at least one link connecting the first distal connection end of the sliding part of the mounting portion to the second distal connection end of the secondary housing; and wherein the pad support portion comprises a pad support portion quick-release mechanism, the pad support portion quick-release mechanism including a locking key interposed between the secondary housing and the pad bracket, in which the locking key is movable between a seated position in which the secondary housing and the pad bracket are coupled together to prevent rotation of the secondary housing relative to the pad bracket and a released position in which the pad bracket is pivotable relative to the secondary housing about the second rotational axis.

11. The lateral support assembly of claim 10, wherein the pad support portion quick-release mechanism includes a biasing spring that biases the locking key into the seated position and further includes a depressible button that is connected to the locking key and is depressible to overcome a biasing force of the biasing spring to move the locking key from the seated position to the released position.

12. The lateral support assembly of claim 11, wherein the pad bracket and the secondary housing have a pivot pin positioned therebetween that join the pad bracket and the secondary housing together, wherein the second axis of rotation extends through the pivot pin, and wherein a central axis of the depressible button is parallel with, but spaced from, the second axis of rotation.

13. The lateral support assembly of claim 10, wherein the at least one link includes a plurality of links connecting the mounting portion to the pad support portion.

14. The lateral support assembly of claim 13, wherein the plurality of links are in series with one another.

15. The lateral support assembly of claim 10, further comprising a plurality of fasteners that selectively fix the at least one link in position relative to the first distal connection end of the sliding part of the mounting portion and that positionally fix the at least one link in position relative to the second distal connection end of the secondary housing of the pad support portion.

16. The lateral support assembly of claim 15, wherein the plurality of fasteners further positionally fix a first link of the at least one link relative to a second link of the at least one link.

17. The lateral support assembly of claim 10, further comprising a pad attached to the pad support portion.

18. The lateral support assembly of claim 10, wherein the mounting portion includes a mounting portion quick-release mechanism, wherein the mounting portion quick-release mechanism selectively holds the mounting portion in a first locked position in which the hinged part is rotationally fixed relative to the attachment part until the mounting portion quick-release mechanism is activated to release the mounting portion from the first locked position such that the hinged part is rotatable relative to the attachment part about the first axis of rotation, and wherein the pad support portion quick-release mechanism selectively holds the pad support portion in a second locked position in which the pad bracket is rotationally fixed relative to the secondary housing until the pad support quick-release mechanism is activated to release the pad support portion from the second locked position such that the pad bracket is rotatable relative to the secondary housing about the second axis of rotation.

19. The lateral support assembly of claim 10, wherein the pad bracket includes a pad mount for selective attachment to a pad and a connecting arm that links the pad mount to the secondary housing and wherein the connecting arm includes a ball joint on one end thereof that is clamped to the pad mount by a clamping plate and further includes a hinged joint on the other end thereof that is connected to the secondary housing by a pivot pin.

20. A lateral support assembly for attachment to a wheelchair, the lateral support assembly comprising:

a mounting portion for attachment to the wheelchair, the mounting portion including an attachment part adapted to be affixed to the wheelchair, a hinged part connected to the attachment part and selectively pivotable about a first rotational axis, and a sliding part connected to the hinged part in which the sliding part is selectively extendable relative to the hinged part to forwardly extend a first distal connection end of the sliding part away from the attachment part;

a pad support portion for attachment to a pad, the pad support portion including a pad bracket coupled to a secondary housing that has a second distal connection end, wherein the pad bracket is selectively pivotable about a second rotational axis; and a link sub-assembly comprising at least one link connecting the first distal connection end of the sliding part of the mounting portion to the second distal connection end of the secondary housing;

wherein the pad bracket includes a pad mount for selective attachment to a pad and a connecting arm that links the pad mount to the secondary housing and wherein the connecting arm includes a ball joint on one end thereof that is clamped to the pad mount by a clamping plate and further includes a hinged joint on the other end thereof that is connected to the secondary housing by a pivot pin.

* * * * *